US005247224A

United States Patent [19]

Bae

[11] Patent Number: 5,247,224

[45] Date of Patent: Sep. 21, 1993

[54] COLOR CATHODE RAY TUBE SHADOW MASK ASSEMBLY

[75] Inventor: Sun-sik Bae, Suwon, Rep. of Korea

[73] Assignee: Samsung Electron Devices Co., Ltd., Kyunggi, Rep. of Korea

[21] Appl. No.: 810,136

[22] Filed: Dec. 19, 1991

[30] Foreign Application Priority Data

Dec. 29, 1990 [KR] Rep. of Korea ..... 90-21738

[51] Int. Cl.[5] ..... H01J 29/07

[52] U.S. Cl. ..... 313/404; 313/405

[58] Field of Search ..... 313/402, 404, 405

[56] References Cited

U.S. PATENT DOCUMENTS 3,529,199 9/1970 Duistermaat et al. ..... 313/404

*Primary Examiner*—Sandra L. O'Shea

*Attorney, Agent, or Firm*—Leydig, Voit & Mayer

[57] ABSTRACT

A color cathode ray tube shadow mask assembly includes a panel having a screen; a shadow mask positioned within the panel; a frame supporting the shadow mask; and a self-compensating hook spring which is fixed to the frame within the panel, suspending the shadow mask assembly within the panel, the hook spring including a fixed planar portion welded to the frame, a coupling part for receiving a stud pin, and a connecting part connecting the coupling part with the fixed planar portion, wherein the distance between the planar portion and the coupling part increases with the distance from the connecting part whereby the fixed planar portion of the hook spring welded to the frame is inclined at a predetermined angle relative to the coupling part. The bending portion between the connecting part and the fixed planar portion is plastically deformed with a smaller force and the angle between the connecting part and the planar portion is smaller than in the conventional hook spring so that the resilience at the bend is not decreased so much. Through the resilience at the bend, the shadow mask frame assembly is flexibly and resiliently supported and the hook spring withstands vibrations better.

2 Claims, 2 Drawing Sheets

COLOR CATHODE RAY TUBE SHADOW MASK ASSEMBLY

BACKGROUND OF THE INVENTION

The present invention relates to a color cathode ray tube, and particularly to an improved self-compensating hook spring of a shadow mask frame assembly.

Generally, a color cathode ray tube includes a shadow mask as a color selecting grid in order that an electron beam emitted from an electron gun accurately lands on a dotted or stripped phosphor layer. As illustrated in FIG. 1, a multitude of electrode beam passing holes 6' are formed in the body of shadow mask 6 whose edge is supported by a rectangular frame 5. A shadow mask frame assembly formed by fixing shadow mask 6 to frame 5 is suspended in the inner space of a panel 3 by means of a self-compensating hook spring provided on the side of frame 5 which is supported by stud pins 4 on the inside of a panel skirt 3*a*.

As illustrated in FIG. 2, when frame 5 faces and is substantially parallel to the inside surface of panel skirt 3*a*, the shadow mask frame assembly is positioned in the internal space of panel 3 such that one end of a hook spring 10 is welded to one side of frame 5. The other end of the hook spring is formed to allow stud pin 4 which is embedded in the inner side of panel skirt 3*a* to be inserted thereinto.

A conventional hook spring 10 is composed of a fixed planar part 11 welded to the side of frame 5, a coupling part 13 having a hole 13*a* into which stud pin 4 is hooked, and substantially parallel with fixed planar part 11, and an angular connecting part 12 for connecting fixed planar part 11 with coupling part 13. The angle formed between fixed planar part 11 and connecting part 12 is generally 40–50 degrees.

The conventional cathode ray tube formed as the above has a problem that hook spring 10 is too severely and elastically strained to stably suspend the shadow mask frame assembly. Here, hook spring 10 including fixed planar part 11 and connecting part 12 is bent by b 40–50 degrees as described above. By this construction, a local plastic deformation occurs while bending the spring of a highly resilient material. Therefore, the resilience at the bending portion is less flexible than at other portions, so that proper resilience, which is required for stably suspending the shadow mask frame assembly to the internal space of panel, is not achieved.

In order to solve aforesaid problems, a method has been suggested wherein the fixed planar part and connecting part are separately manufactured and then welded together. However, this method increases the production time for manufacturing the hook spring, and thus is unfavorable to the productivity of the final product.

SUMMARY OF THE INVENTION

The present invention has been made to solve aforementioned problems.

Accordingly, it is the object of the present invention to provide a color cathode ray tube capable of stably supporting a shadow mask frame assembly and correcting the beam landing errors by maintaining a constant intensity and resilience in a self-compensating hook spring used for suspending the shadow mask frame assembly in the internal space of a panel.

To achieve the object, there is provided a color cathode ray tube comprising: a panel having a screen; a shadow mask positioned within the panel; a frame supporting the shadow mask; and a self-compensating hook spring which is fixed to the frame inside of the panel suspending the shadow mask and frame within the panel, the hook spring including a fixed planar portion welded to the frame, a coupling part for receiving a stud pin, and a connecting part connecting the coupling part with the fixed planar portion, wherein the distance between the planar portion and the coupling part increases with distance from the connecting part, and the fixed planar portion whereby the planar portion of the hook spring welded to the frame is inclined at a predetermined angle relative to the coupling part.

In the cathode ray tube of the present invention, the angle $\theta 1$ between the coupling part and the connecting part is greater than 90 degrees and smaller than 180 degrees, and the angle $\theta 2$ between the fixed plane and the connecting part satisfies the following inequality:

$$\theta 2 \leqq \theta 1 \leqq (180 - \theta 3),$$

where $\theta 3$ is the maximum deflection angle of an electron beam passing through the outermost electron beam passing hole of shadow mask with respect to the center of the shadow mask, and the angle $\theta 2$ is between 110 and 150 degrees.

BRIEF DESCRIPTION OF THE DRAWINGS

These and other objects, features, aspects and advantages of the present invention will become more apparent from the following detailed description of the present invention when taken in conjunction with the accompanying drawings, in which.

DETAILED DESCRIPTION OF THE INVENTION

A color cathode ray tube according to the present invention is constructed similar to that of the conventional assembly which includes a panel with a shadow mask frame assembly in its internal space, and a funnel holding an electron gun in its neck.

Figure 1:
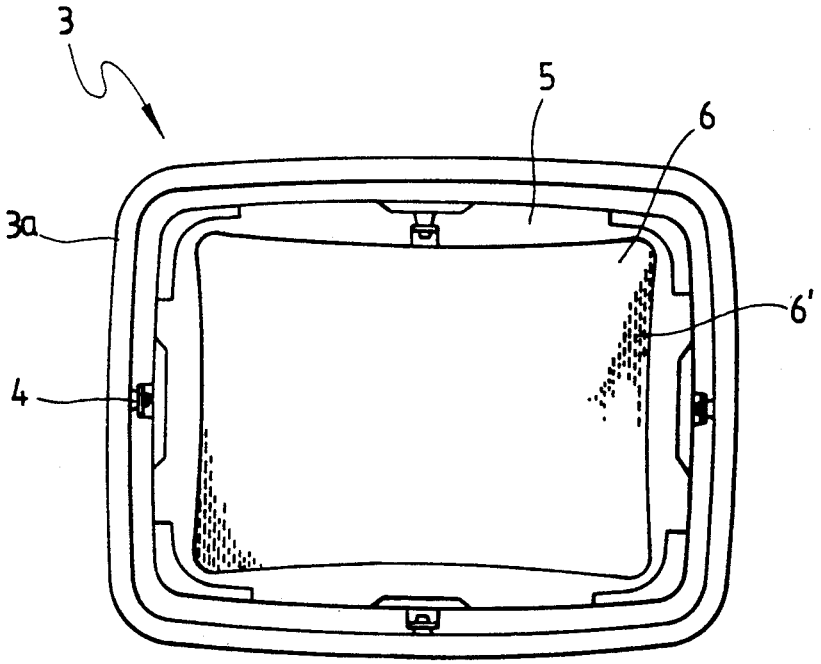
FIG .1 (PRIOR ART)
FIG. 1 is a plan view showing a conventional shadow mask frame assembly mounted inside a panel.
Figure 2:
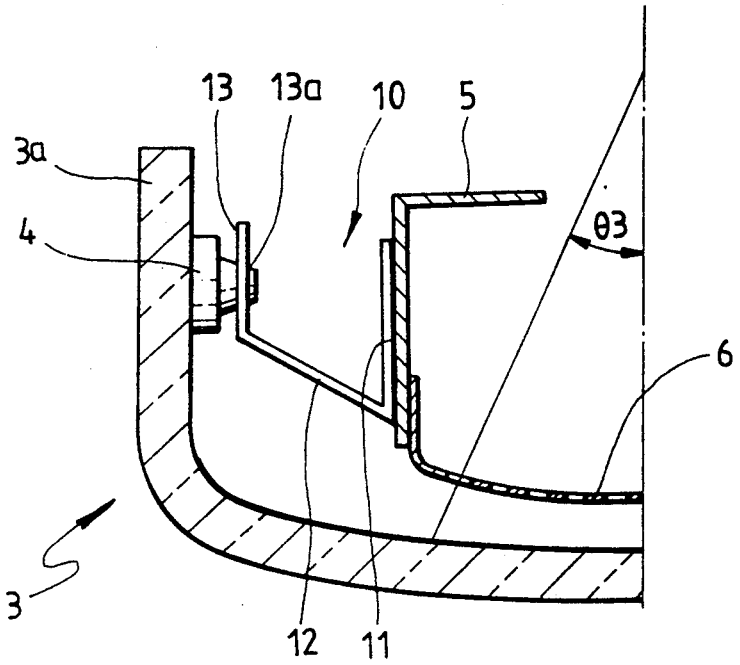
FIG. 2(PRIOR ART)
FIG. 2 is a sectional view taken along line A—A of FIG. 1.
Figure 3:
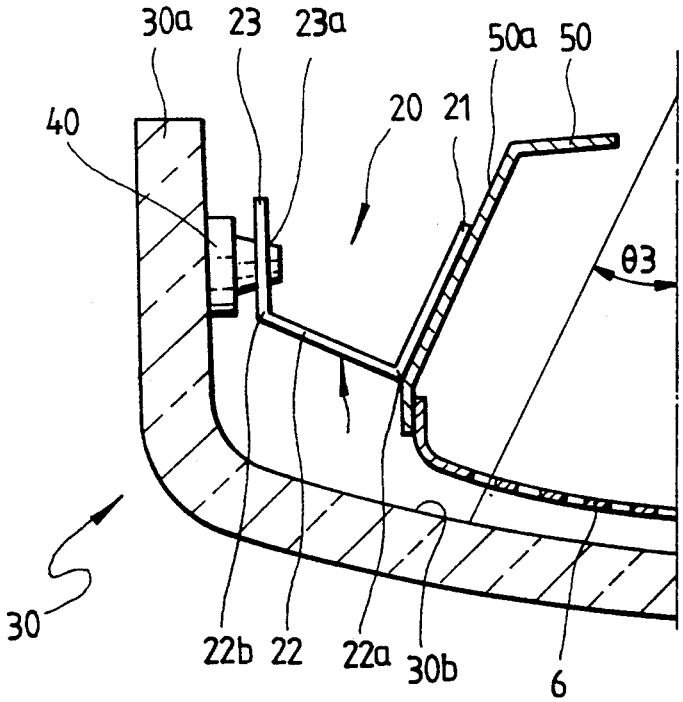
FIG. 3 is a sectional view showing a shadow mask frame assembly mounted inside a panel by means of a self-compensating hook spring according to the present invention.

As illustrated in FIG. 3, the shadow mask frame assembly is suspended by means of a self-compensating hook spring 20 coupled with a stud pin 40 installed on the inside of a panel 30. Hook spring 20 is composed of a fixed planar portion 21 welded to an inclined plane 50*a* of a frame 50, a coupling part 23 in which stud pin 40 provided on panel skirt 30*a* is received and a connecting part 22 connecting fixed planar portion 21 with coupling part 23. Coupling part 23 has a through-hole 23*a* into which stud pin 40 is fitted, and parallel the inside of the panel skirt. Fixed planar portion 21 welded to inclined plane 50*a* of frame 50 is inclined with respect to the inside of panel skirt 30*a*. Connecting part 22 is also inclined with respect to both fixed plane 21 and coupling part 23. A bending portion 22*a* which is the connecting point of fixed planar portion 21 and connecting part 22 is positioned closer to the panel's bottom 30*b* onto which the screen is provided, than a bending portion 22*b* which is the connecting point of connecting part 22 and coupling part 23.

An angle $\theta 1$ between connecting part 22 and coupling part 23 is between 90° and 180°. However, it is desirable that angle $\theta 1$ be set to between from 110° and 150°. An angle $\theta 2$ between fixed planar portion 21 and connecting part 22 varies above or below 90° in accordance with the angle of inclined plane 50*a* of frame 50. For example, angle $\theta 2$ from fixed planar portion 21 to connecting part 22 satisfies the following inequality, provided that the angle between the coupling and connecting parts ranges from 110 to 150 degrees.

$$\theta 2 \leqq \theta 1 \leqq (180 - \theta 3)$$

where, $\theta 3$ is the deflection angle of the electron beam's tracing, i.e., the track of an electron beam passing through the outermost electron beam passing hole of a shadow mask with respect to the electron beam passing through to the center of the shadow mask.

The operation of the aforesaid color cathode ray tube of the present invention constructed as above, is described below.

When the electron beam from an electron gun in the funnel's neck passes through the shadow mask, the shadow mask is heated by electron beam collision. The heat generated at the shadow mask is transmitted to its surroundings and in turn to the frame, thereby thermally expanding the frame. When the frame thermally expands, the hook spring for suspending the shadow mask frame assembly in the panel's internal space is deformed by the frame expansion. Thus, the shadow mask frame assembly moves toward the screen by a minute distance, and the electron beam landing error on the screen caused by the thermal expansion of the shadow mask is corrected.

The bent angle at the bending portion is small enough that plastic deformation of the hook spring of the present invention for correcting the electron beam landing errors is small. This feature is different from the conventional hook. Since the bending portion is properly plastically deformed, it is relatively flexible and has stable resilience. Therefore, the shadow mask can be stably supported by the hook spring of the present invention, and the electron beam landing errors caused by the thermal expansion of the shadow mask and frame is effectively compensated.

That is, in self-compensating hook spring 20, the angle between fixed planar portion 21 welded to inclined portion 50*a* of frame 50 and connecting part 22 bent towards the fixed plane, is greater than that of the conventional hook, thereby providing more resilience.

As described above, the color cathode ray tube according to the present invention has an inclined plane at one side of the frame to which the fixed planar portion of the self-compensating hook spring is welded, so that the distance between the fixed planar portion and the connecting part of the hook spring greatly widens with distance from the connecting part as compared with the conventional one. By widening the distance between the fixed plane and the connecting part, the hook spring is easily welded to the inclined plane of the frame. In addition, less tension is exerted on the bending portion between the connecting part and the fixed planar portion and, accordingly, the decrease in resilience is reduced. The shadow mask frame assembly is supported with flexible resilience at the bending portion, which makes the hook spring durable against vibrations.

What is claimed is:

1. A color cathode ray tube shadow mask assembly comprising:

a panel having a screen;

a shadow mask positioned within and proximate said panel, said shadow mask having a mask portion including a plurality of holes for passing a deflected electron beam and a peripheral flange transverse to said mask portion;

a frame attached to and extending from said peripheral flange of said shadow mask, said frame including a planar portion oblique to said peripheral flange; and a self-compensating hook spring fixed to said frame within said panel, suspending said shadow mask assembly within said panel, said hook spring comprising a planar portion attached to the planar portion of said frame, a coupling part for receiving a stud pin mounted on said panel, and a connecting part connecting said coupling part with said planar portion, wherein said connecting part forms an internal angle $\theta 1$ larger than 90 degrees with said coupling part an internal angle $\theta 2$ larger than 90 degrees with said planar portion of said hook spring.

2. The cathode ray tube shadow mask assembly as claimed in claim 1 wherein the internal angle $\theta 1$ between said coupling part and said connecting part is smaller than 180 degrees, and the internal angle $\theta 2$ between said planar portion of said hook spring and said connecting part is determined from $$\theta 2 \leqq \theta 1 \leqq (180 - \theta 3)$$

where $\theta 3$ is the electron beam deflection angle when the electron beam passes through the hole in said shadow mask closest to said frame and the angle $\theta 1$ is between 110 to 150 degrees.

* * * * *

UNITED STATES PATENT AND TRADEMARK OFFICE

CERTIFICATE OF CORRECTION

PATENT NO. : 5,247,224

DATED : September 21, 1993

INVENTOR(S) : Sun-sik Bae

It is certified that error appears in the above-indentified patent and that said Letters Patent is hereby corrected as shown below:

Claim 1, column 4, line 39, after "part" insert --and--.

Claim 2, column 4, line 53, delete "between".

Signed and Sealed this

Ninth Day of May, 1995

Bruce Lehman

*Attest:*

BRUCE LEHMAN

*Attesting Officer*

*Commissioner of Patents and Trademarks*